US006459385B2

(12) United States Patent
Yamashita

(10) Patent No.: US 6,459,385 B2
(45) Date of Patent: Oct. 1, 2002

(54) NON-STOP TOLL COLLECTION SYSTEM AND METHOD

(75) Inventor: Hiroshi Yamashita, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/865,486

(22) Filed: May 29, 2001

(30) Foreign Application Priority Data

May 30, 2000 (JP) ..... 2000-159602

(51) Int. Cl.[7] ..... G08G 1/00
(52) U.S. Cl. ..... 340/928; 340/933; 340/935
(58) Field of Search ..... 340/928, 933, 340/935, 937, 988; 701/213, 216; 705/417

(56) References Cited

U.S. PATENT DOCUMENTS

| | | | | |
|---|---|---|---|---|
| 5,686,906 A | * | 11/1997 | Ono et al. | 340/928 |
| 5,721,678 A | * | 2/1998 | Widl | 705/417 |
| 5,767,505 A | * | 6/1998 | Mertens et al. | 340/988 |
| 5,805,082 A | * | 9/1998 | Hasett | 340/928 |
| 6,140,941 A | * | 10/2000 | Dwayer et al. | 340/928 |

FOREIGN PATENT DOCUMENTS

| | | |
|---|---|---|
| JP | 5-008677 | 2/1993 |
| JP | 3011907 | 3/1995 |
| JP | 11-175786 | 2/1999 |
| JP | 2985873 | 11/1999 |

* cited by examiner

*Primary Examiner*—Van Trieu
(74) *Attorney, Agent, or Firm*—Whitham, Curtis & Christofferson, P.C.

(57) ABSTRACT

A non-stop toll collection system has a plurality of road-side radio apparatuses having mutually different radio communication regions, which transmit identification signals responsive to the installation locations thereof, a vehicle-mounted apparatus, which receives an identification signal, records a communication log for each road-side radio apparatus, in response to the identification signal, and transmits the communication log, wherein each of the plurality of road-side radio apparatuses receives the communication log and wherein, in the case in which the communication log indicates that another road-side radio apparatus and the vehicle-mounted apparatus have already communicated, the vehicle-mounted apparatus is instructed to perform billing processing.

10 Claims, 4 Drawing Sheets

NON-STOP TOLL COLLECTION SYSTEM AND METHOD

BACKGROUND OF THE INVENTION

1. Field of the Invention

The present invention relates to an automatic nonstop toll collection system, which is one field related to an intelligent transport system (ITS), and more particularly to a toll collection system with respect to a vehicle-mounted apparatus.

2. Related Art

A toll collection system of the past with respect to a vehicle-mounted apparatus is described below, using the example of a uniform toll entrance collection system. Road-to-vehicle communication between a road-side radio apparatus and a vehicle-mounted apparatus is performed by the road-side radio apparatus transmitting a control signal. Specifically, when the vehicle-mounted apparatus comes up to the entrance to a toll road, so that it comes within the limited radio communication region of the road-side radio apparatus, it receives the control signal transmitted by the road-side radio apparatus. Upon receiving the control signal, the vehicle-mounted apparatus exchanges data with the road-side radio apparatus under control by the control signal, thereby performing billing processing.

The prior art, however, had the following problems.

In the above-noted billing processing of the past, the system operates normally with the road-side radio apparatus installed in a very limited location, this being at an entrance toll area or a toll road or the like. If this system is applied to a general road, there is a possibility that a mis-billing will occur with respect to a vehicle if the system is operated so as to bill a vehicle that has entered a tolled area, in which a toll must be collected. Specifically, on the usual two-way road, and in particular such a road having narrow lanes, in contrast to a toll road having a one-way entrance toll collection lane, even a vehicle exiting from the tolled area must pass through the limited radio communication region of the road-side radio apparatus. There is the problem, therefore, that even when a vehicle is exiting, it might communicate with the road-side radio apparatus, resulting in it being erroneously billed.

For example,a Registered Japanese Utility Model No 3011907 and a Japanese unexamined Utility Model publication (KOKAI) No.5-8677 show the similar technology related to the automatic non-stop toll collection system to those as mentioned above but they also have the same problems as mentioned above.

Accordingly, it is an object of the present invention, in view of the above-noted problem, to provide a non-stop toll collection system and method, capable of achieving, by means of road-side radio communication, proper billing that is performed only with respect to a vehicle entering an area requiring the billing of a toll.

SUMMARY OF THE INVENTION

To achieve the above-noted object, the present invention adopts the following basic technical constitution.

Specifically, a first aspect of the present invention is a non-stop toll collection system having a plurality of road-side radio apparatuses having mutually different radio communication regions, which transmit identification signals responsive to the installation locations thereof, a vehicle-mounted apparatus, which receives an identification signal, records a communication log for each road-side radio apparatus, in response to the identification signal, and transmits the communication log, wherein each of the plurality of road-side radio apparatuses receives the communication log and wherein, in the case in which the communication log indicates that another road-side radio apparatus and the vehicle-mounted apparatus have already communicated, the vehicle-mounted apparatus is instructed to perform billing processing.

A second aspect of the present invention is a variation on the non-stop toll collection system of the first aspect, wherein at a particular road-side radio apparatus of the plurality of road-side radio apparatuses, if the identification signal of a road-side radio apparatus with which the vehicle-mounted apparatus has already communicated as indicated by the communication log therefrom is the identification signal of a road-side radio apparatus to the rear of the current road-side radio apparatus in the direction of vehicle travel, instruction is given to the vehicle-mounted apparatus to perform billing processing.

A third aspect of the present invention is a variation on the non-stop toll collection system of either the first or second aspect, wherein each of the plurality of road-side radio apparatuses repeatedly transmits one frame of transmitted data, made up of a plurality of slots, control Information with respect to the vehicle-mounted apparatus being added to the control signal in the one frame, identification signals responsive to each of the installation locations for the plurality of road-side radio apparatuses being added to this control information.

A fourth aspect of the present invention is a variation on the non-stop toll collection system of any of the first to third aspects, wherein the plurality of road-side radio apparatuses are installed in a line along the direction of travel of the vehicle.

A fifth aspect of the present invention is a non-stop toll collection method whereby identification signals responsive to the installation locations of a plurality of road-side radio apparatuses having mutually different radio communication regions are sent by the road-side radio apparatuses, a vehicle-mounted apparatus receives the identification signals and, in response to the identification signals, records a communication log for each of the road-side radio apparatuses, each of the plurality of road-side radio apparatuses, receives the communication log and, if the communication log indicates that another road-side radio apparatus and the vehicle-mounted apparatus have already communicated, instructs the vehicle-mounted apparatus to perform billing processing.

A sixth aspect of the present invention is variation on the non-stop toll collection system of the fifth aspect, wherein at a particular road-side radio apparatus of the plurality of road-side radio apparatuses, if the identification signal of a road-side radio apparatus with which the vehicle-mounted apparatus has already communicated an indicated by the communication log therefrom is the identification signal of a road-side radio apparatus to the rear of the current road-side radio apparatus in the direction of vehicle travel, instruction is given to the vehicle-mounted apparatus to perform billing processing.

A seventh aspect of the present invention is a variation on the non-stop toll collection system of either the fifth or sixth aspect, wherein each of the plurality of road-side radio apparatuses repeatedly transmits one frame of transmitted data, made up a plurality of slots, control information with respect to the vehicle-mounted apparatus being added to the control signal in the one frame, identification signals responsive to each of the installation locations for the plurality of road-side radio apparatuses being added to this control information.

An eighth aspect of the present invention is a storage medium having an executable program for a non-stop toll collection method according to any of the fifth to seventh aspects of the present invention.

Whereas only one road-side radio apparatus was used in the past, the present invention uses two sets of road-side radio apparatuses. Additionally, the road-side radio apparatuses are provided with a function that determines what road-side radio apparatuses a vehicle-mounted apparatus has communicated with, by accessing the communication log information via road-to-vehicle communication.

The road-side radio apparatus adds an identification signal responsive to the installation location to the control information with an Na slot, which is the transmitted control signal. That is, there is transmission of information that indicates whether it is located either forward of or to the rear of vehicle a rolled zone, with respect to the direction or travel of the vehicle. The vehicle-mounted apparatus, based on installation information showing the installation location indicated by the received identification signal, identifies the road-side radio apparatus and records whether or not there is radio communication.

DETAILED DESCRIPTION OF THE PREFERRED EMBODIMENTS

Embodiments of the present invention are described in detail below, with references made to relevant accompanying drawings.

Figure 1:
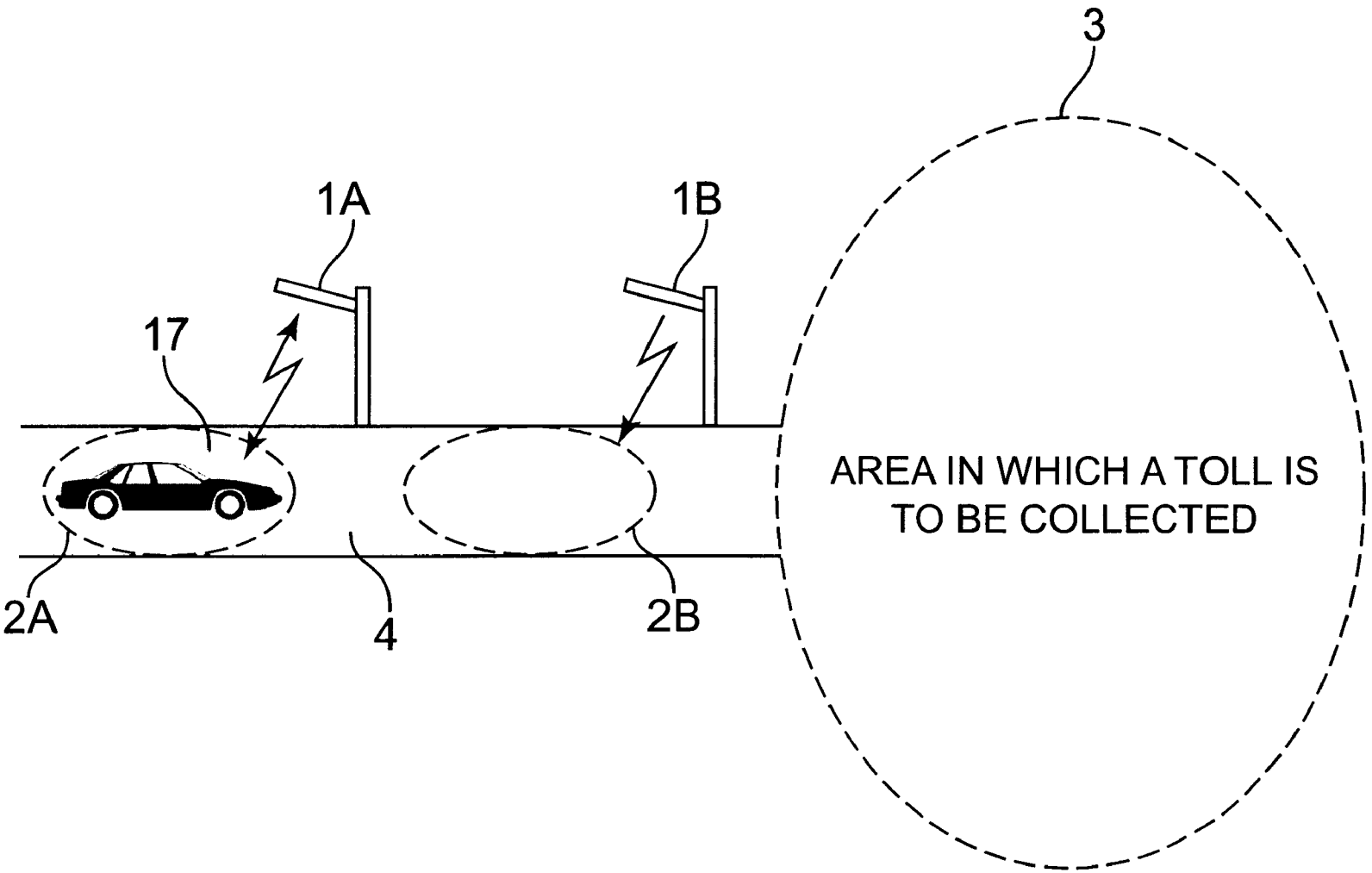
FIG. 1 is a block diagram representing a system configuration of a first embodiment of the present invention.

Specifically, FIG. 1 shows a non-stop toll collection system according to a first embodiment of the present invention, this being a uniform toll entrance billing system, in which a vehicle to be billed a roll performs road-to-vehicle communication with a road-side radio apparatus 1*a* and then with a road-side radio apparatus 1*b*. in this system, the road-side radio apparatuses 1*a* and 1*b* are disposed along the road 4 such that their respective limited communication regions 2*a* and 2*b* do not overlap.

Figure 2:
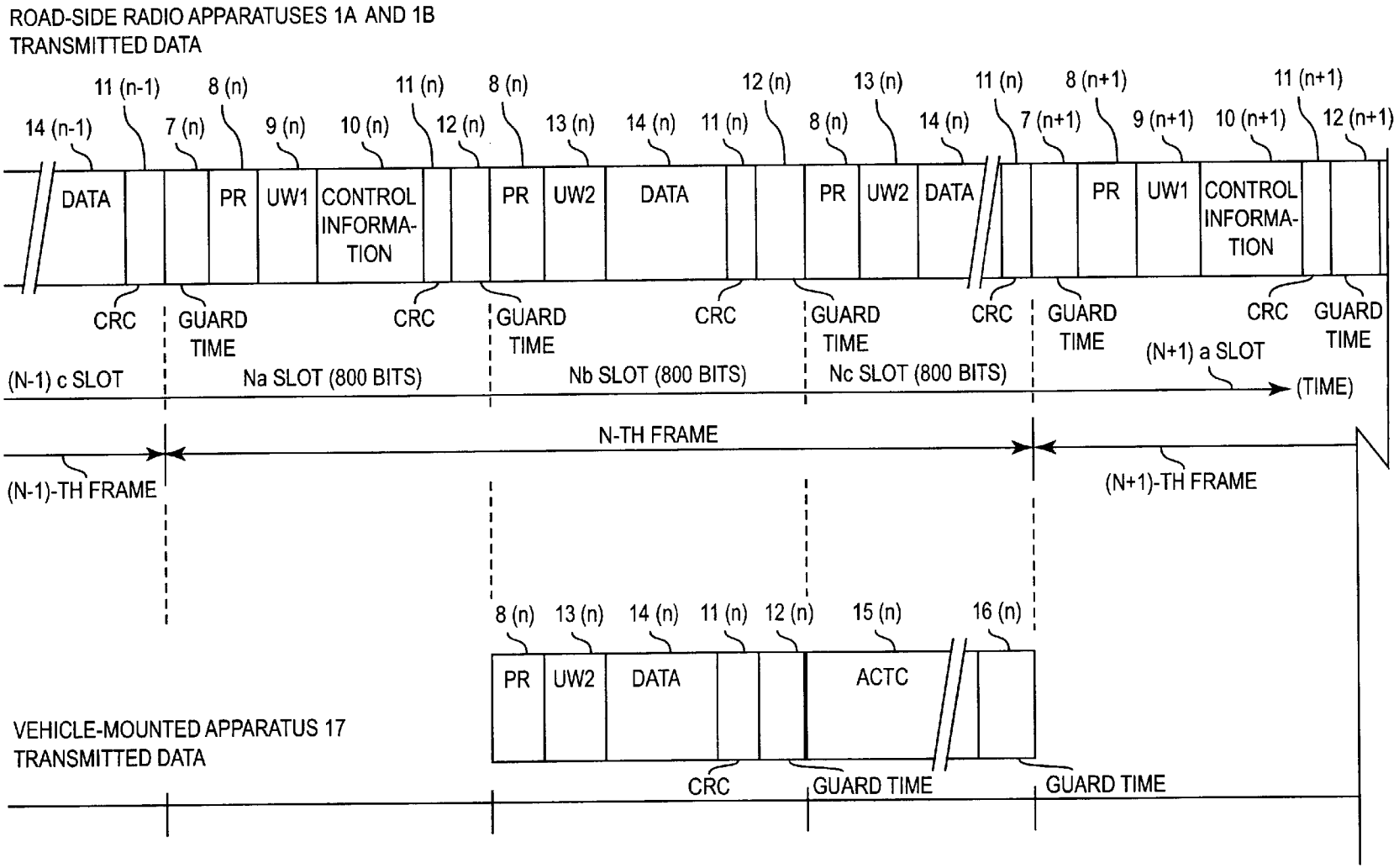
FIG. 2 is a drawing of a transmitted data stream of a road-side radio apparatus and a vehicle-mounted apparatus according to the present invention, showing examples of the transmitted data continuously sent from the road-side radio apparatus and the transmitted data sent from the vehicle-mounted apparatus.

FIG. 2 shows examples of data continuously transmitted by the road-side radio apparatus 1*a* and the road-side radio apparatus 1*b*, and data transmitted by a vehicle-mounted apparatus 17. The data continuously transmitted by the road-side radio apparatuses 1*a* and 1*b* has one frame made up of a plurality of slots, this being repeatedly transmitted. Taking the example of the N-th frame, and in particular of the control signal in the N-th frame, control information 10 (n) with respect to the vehicle-mounted apparatus 17 is added to the first Na slot.

In the case in which road-to-vehicle communication is being conducted, the road-side radio apparatuses 1*a* and 1*b* transmit only the Na slot, the slots Na and Nc being empty slots. In the drawings and the description that follows, the frame previous to the N-th frame is the (N−1)-th frame, and the frame after the N-th frame is the (N+1)-th frame. To elements within the N-th frame, the symbol (n) is appended, and similarly to elements within the (N−1)-th and (N+1)-th frames, The symbols (n−1) and (n+1), respectively, are appended.

Referring to FIG. 1 and FIG. 2, the description that follows is rot the example in which road-to-vehicle communication is being conducted between the vehicle-mounted apparatus 17 and the road-side radio apparatus 1*a*. Because the case in which road-to-vehicle communication is being performed between the vehicle-mounted apparatus 17 and the road-side radio apparatus 1*b* is similar to the case of road-to-vehicle communication with the road-side radio apparatus 1*a*, its description will be omitted.

First, when the vehicle-mounted apparatus 17 enters within the radio communication region 2*a* of the road-side radio apparatus 1*a*, UW1 (the first unique word) in the Na slot is detected, and synchronization is established of the time slot of the vehicle-mounted apparatus itself with the road-side radio apparatus 1*a*. Then the vehicle-mounted apparatus 17 receives the subsequent control information 10 (n) and performs a data error check by using the CRC (cyclical redundancy control) 11 (n). If no error is detected, the data contents are interpreted, and an ACTC (radio link connection request command) 15 (n) in a time slot in which transmission by the vehicle-mounted apparatus 17 is permitted.

Upon receiving the ACTC 15 (n), the road-side radio apparatus 1*a* makes notification of the vehicle-mounted apparatus 17 receiving time slot by control information 10 (n+1) in the (N+1) a slot, and transfers the data 14 (n+1) to the vehicle-mounted apparatus 17 during the (N+1) b or (N+1) c slot (not shown in the drawing).

Information such as the type of road-side radio apparatus 1*a* and road-side radio apparatus 1*b*, the link address of the vehicle-mounted apparatus 17, and the next transmission time slot for the vehicle-mounted apparatus 17 is included in the N-th frame control information 10 (n) If the vehicle-mounted apparatus 17 succeeds in reading the data within the Nb or Nc slot, it interprets the data contents, and then returns a response in a transmission time slot Instructed by the road-side radio apparatus 1*a*. The data in the Nb or Nc time slot includes detailed information with regard to the toll billing transmitted and received between the road-side radio apparatus 1*a* and the vehicle-mounted apparatus 17, this data being exchanged to execute billing proper billing processing.

In FIG. 2, PR (preamble) 8 (n) and 8 (n+1) are continuous 1 and 0 data for the generation of a receive clock by the vehicle-mounted apparatus opposite a radio zone, UW2 13 (n) is a second unique word, guard times 12 (n) and 12 (n+1) are non-transmission time periods for providing protection so that data duplication does not occur because of up-link time variations of the vehicle-mounted apparatus opposing the radio zone.

Figure 3:
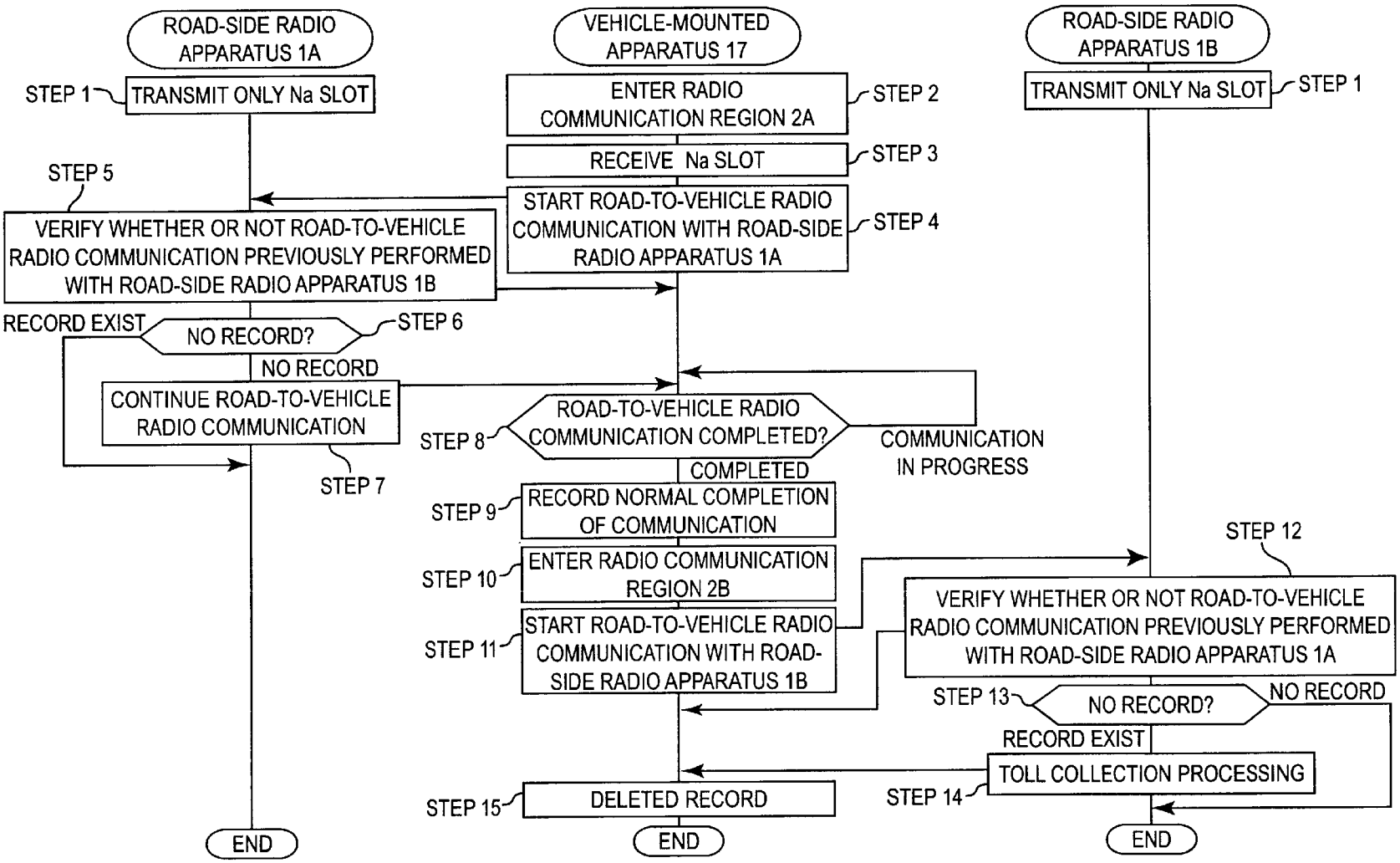
FIG. 3 is a flowchart showing the operation of the first embodiment of the present invention.

The operation of this embodiment of the present invention is described below, with reference to the flowchart of FIG. 3, and this aspect of the present invention is illustrated in FIG. 1 through FIG. 3 In the case in which road-to-vehicle radio communication is not being performed, the road-side radio apparatus 1*a* and the road-side radio apparatus 1*b* transmit only the Na slot (step 1). When a vehicle from which a toll is to be collected enters the radio communication region 2*a*, the vehicle-mounted apparatus 17 installed therein receives a control signal from the road-side radio apparatus 1*a*, this being in the Na slot shown in FIG. 2 (step 2 and step 3), thereby starting road-to-vehicle radio communication (step 4). When this occurs, the road-side radio apparatus 1*a* and road-side radio apparatus 1*b* add an identification signal responsive to an installation condition, such as the installation location to the control information 10 (n) within the Na slot. In the case of FIG. 1, two road-side radio apparatus are installed in a vertical line, with the road-side radio apparatus 1*a* being in front and the road-side radio apparatus 1*b* being in the rear, each transmitting a respective identification signal.

When road-to-vehicle radio communication is started, the vehicle-mounted apparatus opposite the road-side radio apparatus 1*a* verifies whether or not it has performed road-to-vehicle radio communication before with road-side radio apparatus 1*b* (step 5), and only in the case in which it had not continues to perform road-to-vehicle radio communication (step 6 and step 7). At step 5, in the case in which there is a record that road-to-vehicle radio communication had been performed before with the road-side radio apparatus 1*b*, the road-side radio apparatus 1*a* does not perform any further communication (step 6).

When normal road-to-vehicle radio communication is completed, the vehicle-mounted apparatus 17 records the fact that communication has been normally completed, using internally incorporated software or the like (step 8 and step 9).

When the vehicle from which a toll is to be collected travels further forward so as to enter the radio communication region 2*b* (step 10), the, vehicle-mounted apparatus 17 starts the same type of radio communication between itself and the road-side radio apparatus 1*b* (step 11). At this point, the road-side radio apparatus 1*b* verifies by sending and receiving data within the Nb or Nc time slot of FIG. 2 that communication with the road-side radio apparatus 1*a* has already been completed normally (step 12). If the verification indicates that communication ended normally, billing processing is performed with respect to the vehicle-mounted apparatus 17 (step 13 and step 14).

In the case in which road-to-vehicle radio communication between the vehicle-mounted apparatus 17 and the road-side radio apparatus 1*b* has begun, this is recorded by the vehicle-mounted apparatus 17 In the case, however, in which the proper toll collection processing has been performed, the recording is deleted (step 15). At step 12, in the case in which there is no record that road-to-vehicle radio communication with the road-side radio apparatus 1*a* had been done, the road-side radio apparatus 1*b* performs no further communication (step 13).

For a vehicle from which a toll is to be collected leaves the toll collection area 3, it first enters the radio communication region 2*b*.

At this point, the vehicle-mounted apparatus 17 starts road-to-vehicle radio communications and the road-side radio apparatus 1*b* verifies in the same manner whether or not radio communication between the vehicle-mounted apparatus 17 and the road-side radio apparatus 1*a* have ended normally. When this is done, because the roadside radio apparatus 1*b* cannot verify the normal completion of communication by the vehicle-mounted apparatus 17, toll collection processing is not executed. If road-to-vehicle radio communication with the road-side radio apparatus 1*b* has started, the vehicle-mounted apparatus 17, in the same manner as described above, records this.

When the vehicle from which a toll is to be collected travels forward still farther, so as to enter the radio communication region 2*a*, in the same manner road-to-vehicle radio communication with the road-side radio apparatus 1*a* is started. The road-side radio apparatus 1*a* detects that the vehicle-mounted apparatus 17 had previously performed road-to-vehicle radio communication with the road-side radio apparatus 1*b*. For this reason, a judgment is made that the vehicle from which a toll is to be collected has proceeded from the toll collection area 3 in the exiting direction, road-to-vehicle radio communication is ended, and toll collection processing is performed.

By adopting the above-described constitution, the non-stop toll collection according to this embodiment of the present invention achieves the effect of being able to perform non-stop toll collection with regard to a vehicle-mounted apparatus 17 on a general road, without being restricted in terms of the installation environment, such as is the case with a toll road toll collection area.

Figure 4:
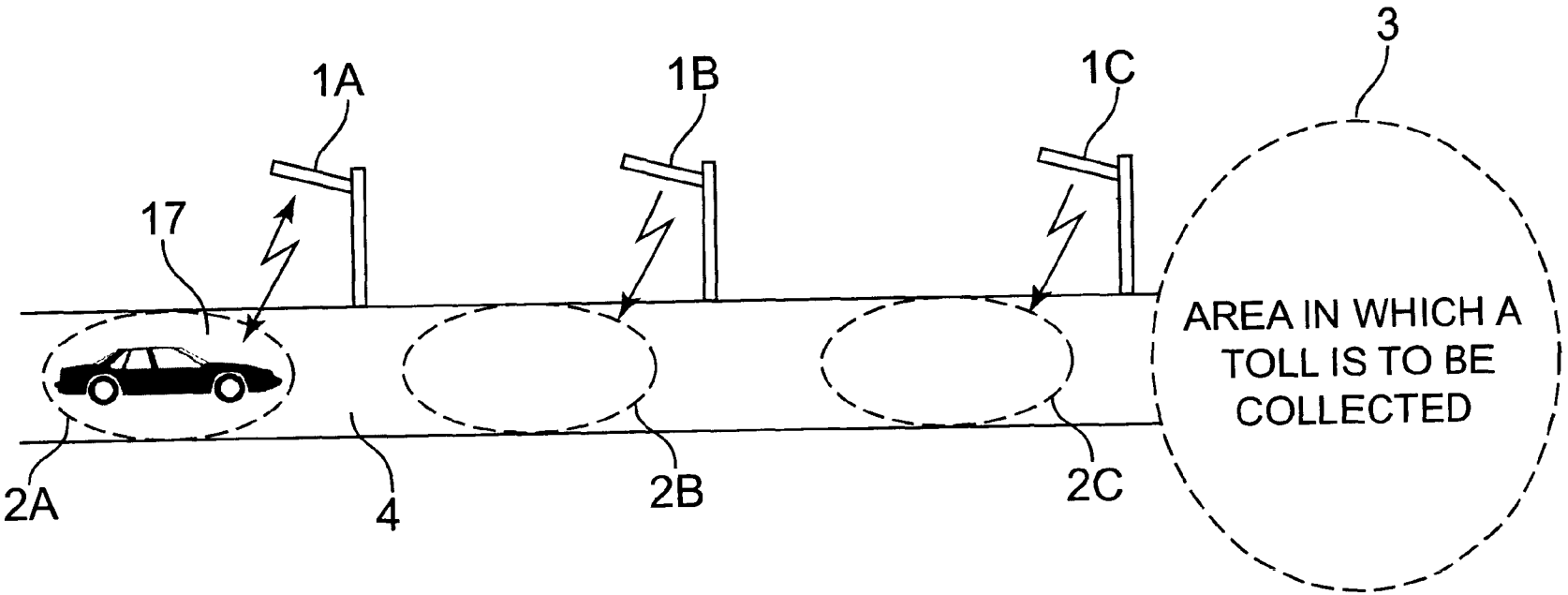
FIG. 4 is a block diagram representing a system configuration of a second embodiment of the present invention.

A second embodiment of a non-stop toll collection system according to the present invention is shown in FIG. 4, in which the difference with respect to the first embodiment is that there are 3 sets of road-side radio apparatuses to achieve toll collection processing, other aspects of the embodiment being the same as the first embodiment. In the case in which the amount of data transmitted and received with regard to toll collection is large, it is possible to provide an even larger number of road-side radio apparatuses.

It will be understood that the above-described embodiments of the present invention do not restrict the present invention, which can take other forms of application.

Additionally, the quantities, positions, shapes, and so forth in the present invention are not restricted to those noted in the above-described embodiments, but can be other preferred quantities, positions, shapes, and so forth in other embodiments of the present invention.

It will also be noted that in the several accompanying drawings, elements appearing in more than one drawing are assigned the same reference numeral in each drawing they appear.

By adopting the above-described constitution, the present invention achieves the effect of being able to provide a non-stop toll collection system, which performs road-to-vehicle radio communication with only a vehicle entering an area in which a toll is to be collected, thereby enabling proper collection of a toll from the

What is claimed is:

1. A non-stop toll collection system comprising:

a plurality of road-side radio apparatuses having mutually different radio communication regions, which transmit identification signals responsive installation locations thereof;

a vehicle-mounted radio apparatus, which receives an identification signal, records a communication log for each said road-side radio apparatus, in response to said identification signal, and transmits said communication log, wherein each of said plurality of road-side radio apparatuses receives said communication log and wherein, in a case in which said communication log indicates that another road-side radio apparatus in a sequence of road-side radio apparatuses commencing from an entrance to a toll road and said vehicle-mounted radio apparatus have already communicated, said vehicle-mounted radio apparatus is instructed to perform billing processing.

2. A non-stop toll collection system according to claim 1, wherein at a particular road-side radio apparatus of said plurality of road-side radio apparatuses, if said identification signal of said road-side radio apparatus with which said vehicle-mounted apparatus has already communicated as indicated by said communication log therefrom is an identification signal of a road-side radio apparatus to the rear of said current road-side radio apparatus in a direction or vehicle travel, instruction is given to said vehicle-mounted apparatus to perform billing processing.

3. A non-stop toll collection system according to claim 1, wherein each or said plurality of road-side radio apparatuses repeatedly transmits one frame of transmitted data, made up of a plurality of slots, control information with respect to said vehicle-mounted apparatus being added to a control signal in said one frame, identification signals responsive to each of said installation locations for said plurality of road-aide radio apparatuses being added to said control information.

4. A non-stop toll collection system according to claim 1, therein said plurality of road-side radio apparatuses are installed in a line along a direction of travel of said vehicle.

5. The non-stop toll collection system according to claim 1, wherein if said communication log indicates that the sequence of road-side radio apparatuses communicating with the vehicle-mounted radio apparatus is not in a sequence commencing form an entrance to the toll road, said vehicle-mounted radio apparatus is instructed to delete the communication log.

6. A non-stop toll collection method comprising the steps of:

providing a plurality of road-side radio apparatuses having mutually different radio communication regions;

sending by the road-side radio apparatuses identification signals responsive installation locations thereof;

providing a vehicle-mounted radio apparatus;

receiving by the vehicle-mounted radio apparatus said identification signals and, in response to said identification signals, recording and transmitting a communication log for each said road-side radio apparatus; and receiving by each of said plurality of road-side radio apparatuses said communication log and, if said communication log indicates that another road-side radio apparatus in a sequence of road-side radio apparatuses commencing from an entrance to a toll road and said vehicle-mounted radio apparatus have already communicated, instructing said vehicle-mounted radio apparatus to perform billing processing.

7. A non-stop toll collection method according to claim 6, further comprising the step of giving by a particular one of said plurality of road-side radio apparatuses, if said identification signal of a road-side radio apparatus with which said vehicle-mounted radio apparatus has already communicated as indicated by said communication log therefrom is an identification signal of a road-side radio apparatus to the rear of the current road-side radio apparatus in a direction of vehicle travel, an instruction to said vehicle-mounted radio apparatus to perform billing processing.

8. A non-stop toll collection method according to claim 6, wherein each of the plurality of road-side radio apparatuses repeatedly transmits one frame of transmitted data, made up of a plurality of slots, control information with respect to the vehicle-mounted radio apparatus being added to the control signal in the one frame, identification signals responsive to each of the installation locations for the plurality of road-side radio apparatuses being added to this control information.

9. The non-stop toll collection method according to claim 6, wherein if said communication log indicates that the sequence of road-side radio apparatuses communicating with the vehicle-mounted radio apparatus is not in a sequence commencing form an entrance to the toll road, instructing said vehicle-mounted radio apparatus to delete the communication log.

10. A storage medium having an executable program for non-stop toll collection method executable on a plurality of road-side radio apparatuses having mutually different radio communication regions and a vehicle-mounted radio apparatus, the executable program comprising the steps of:

sending by the road-side radio apparatuses identification signals responsive installation locations thereof;

receiving by the vehicle-mounted radio apparatus said identification signals and, in response to said identification signals, recording and transmitting a communication log for each said road-side radio apparatus; and receiving by each of said plurality of road-side radio apparatuses said communication log and, if said communication log indicates that another road-side radio apparatus in a sequence of road-side radio apparatuses commencing from an entrance to a toll road and said vehicle-mounted radio apparatus have already communicated, instructing said vehicle-mounted radio apparatus to perform billing processing.

* * * * *